US005377648A

United States Patent [19]

Iwata

[11] Patent Number: 5,377,648

[45] Date of Patent: Jan. 3, 1995

[54] DEVICE FOR PURIFYING FUEL

[76] Inventor: Yosihiro Iwata, 809-2, Higashiirushuzei-cho, Sagaru Nijyo Senbondori, Kamigyo-ku, Kyoto-shi, 602, Japan

[21] Appl. No.: 134,069

[22] Filed: Oct. 12, 1993

[51] Int. Cl.[6] ..... F02M 27/00

[52] U.S. Cl. ..... 123/538; 123/25 R

[58] Field of Search ..... 123/536, 538, 25 R

[56] References Cited

U.S. PATENT DOCUMENTS

| | | | |
|---|---|---|---|
| 3,830,621 | 8/1974 | Miller . | |
| 4,188,296 | 2/1980 | Fujita . | |
| 4,315,895 | 2/1982 | Bramer et al. . | |
| 4,326,954 | 4/1982 | Shroyer | 123/538 |
| 4,355,969 | 10/1982 | Nelson et al. | 123/536 |
| 4,380,978 | 4/1983 | Maynard, Jr. et al. | 123/536 |
| 4,381,754 | 5/1983 | Heckel | 123/536 |
| 4,568,901 | 2/1986 | Adam | 123/538 |
| 4,569,737 | 2/1986 | Sakata . | |
| 4,572,145 | 2/1986 | Mitchell et al. | 123/538 |
| 4,716,024 | 12/1987 | Pera . | |
| 4,865,747 | 9/1989 | Larson et al. . | |
| 4,933,151 | 6/1990 | Song . | |
| 4,975,406 | 12/1990 | Frestad et al. . | |
| 4,985,213 | 1/1991 | Ooe et al. . | |
| 5,059,743 | 10/1991 | Sakuma . | |
| 5,154,142 | 10/1992 | Kamo | 123/536 |
| 5,236,670 | 8/1993 | Iwata | 422/186.04 |
| 5,320,726 | 6/1994 | Iwata | 204/157.15 |

FOREIGN PATENT DOCUMENTS 62-233468 10/1987 Japan .

OTHER PUBLICATIONS

Figures 1 through 6 from Applicant's co-pending Ser. No. 07/893 391.

*Primary Examiner*—Willis R. Wolfe
*Assistant Examiner*—Erick Solis
*Attorney, Agent, or Firm*—Flynn, Thiel, Boutell & Tanis

[57] ABSTRACT

A device for purifying fuel comprises arc-shaped conductive plates facing each other arranged on the outer periphery of a fuel communication synthetic resin pipe interposed in a fuel supply pipe between a fuel tank and an engine, a protective cover for covering the outer peripheries of the arc-shaped conductive plates and an AC signal generator means coupled to a battery for applying a low frequency, low voltage and low current AC signal between the arc-shaped conductive plates. As a result, it is possible to provide a device for purifying fuel which is safe, easily controllable, of low cost and reliable.

4 Claims, 3 Drawing Sheets

DEVICE FOR PURIFYING FUEL

BACKGROUND OF THE INVENTION

1. Technical Field

The present invention relates to a device for purifying fuel for improving the quality of a fuel such as gasoline, gas oil or heavy oil used in an engine of an automobile, etc., so as to purify exhaust gas.

2. Prior Art

There is a well-known device for purifying fuel such that disclosed in Japanese Patent Laid-Open Publication No. 62-233468, wherein the device comprises a conductive coil covered by an oil-resistant and acid-resistant insulating cover in a the tank and a high voltage AC signal generator for applying a low frequency AC signal to the conductive coil.

The conventional devices set forth above, however, have problems that high voltage used therein is very dangerous, processing fuel in the fuel tank causes voltage fluctuation due to the change of the oil surface that prevents control, a huge amount of fuel has to be processed at the same time taking a long time and the conductive coil cannot be easily attached to or detached from the device.

Accordingly, the inventor previously invented a device for purifying fuel that applies an electromagnetic induction field generated by a low voltage and low current signal to fuel and/or water along the supply line thereof so as to be safe, easily controllable and of low cost (refer to U.S. patent application Ser. No. 07/893391 and U.S. patent application Ser. No. 08/068693).

The invention set forth above, however, has a risk that the electromagnetic induction field insufficiently influences the fuel and consequently insufficiently purifies the fuel in case the fuel flows in supply pipes, etc., without filling the same since the conductive coil arranged outside the fuel is employed for applying the electrostatic field to the fuel or water by way of a low voltage and low current signal flowing therein.

SUMMARY OF THE INVENTION

The present invention has been made in view of such problems of the prior art to provide a device for purifying fuel that is safe, easily controllable, of low cost and reliable by employing a pair of arc-shaped conductive plates facing each other for applying an electrostatic induction field to fuel and/or water along the supply pipe thereof by way of a low voltage and low current AC signal applied therebetween.

In order to attain the above object, the device for purifying fuel according to the present invention is characterized in comprising a pair of arc-shaped conductive plates facing each other that are arranged on the outer periphery of a fuel communication synthetic resin pipe interposed in a fuel pipe between a fuel tank and an engine and a protective cover for covering the arc-shaped conductive plates and an AC signal generator that is coupled to a battery and supplies a low frequency, low voltage and low current signal to the arc-shaped conductive plates.

Moreover a device for supplying hydrous fuel according to the present invention which comprises a fuel supply pipe coupled to a fuel tank, a water supply pipe coupled to a water tank and a hydrous fuel supply pipe for supplying the hydrous fuel to an engine is characterized in comprising pairs of arc-shaped conductive plates facing each other each pair arranged at least on each of the outer peripheries of synthetic resin pipes interposed in the water supply pipe and the hydrous fuel supply pipe and an AC signal generator which is coupled to a battery and applies a low frequency, low voltage and low current signal between each pair of the arc-shaped conductive plates set forth above.

It is possible to cause a molecular variation in fuel and/or water so as to increase oxygen dissolved in the fuel and/or water by applying an electrostatic induction field generated by the low frequency, low voltage and low current signal applied between the arc-shaped conductive plates facing each other so that it is possible to remarkably reduce $NO_X$ or CO contained in exhaust gas. Since the process is performed along the supply pipes between the tanks and the engine, the electrostatic induction field influences concentratedly and uniformly the fuel and/or water in the fuel and/or water supply pipe so as to facilitate the improvement of the fuel and/or water in quality. Even if the fuel and/or water is supplied not so sufficiently as to fill the supply pipe as it flows therethrough, it is purified by the electrostatic induction field with certainty if a part of the flowing fuel and/or water is in the region of the arc-shaped conductive plates facing each other.

PREFERRED EMBODIMENT OF THE INVENTION

Figure 1:
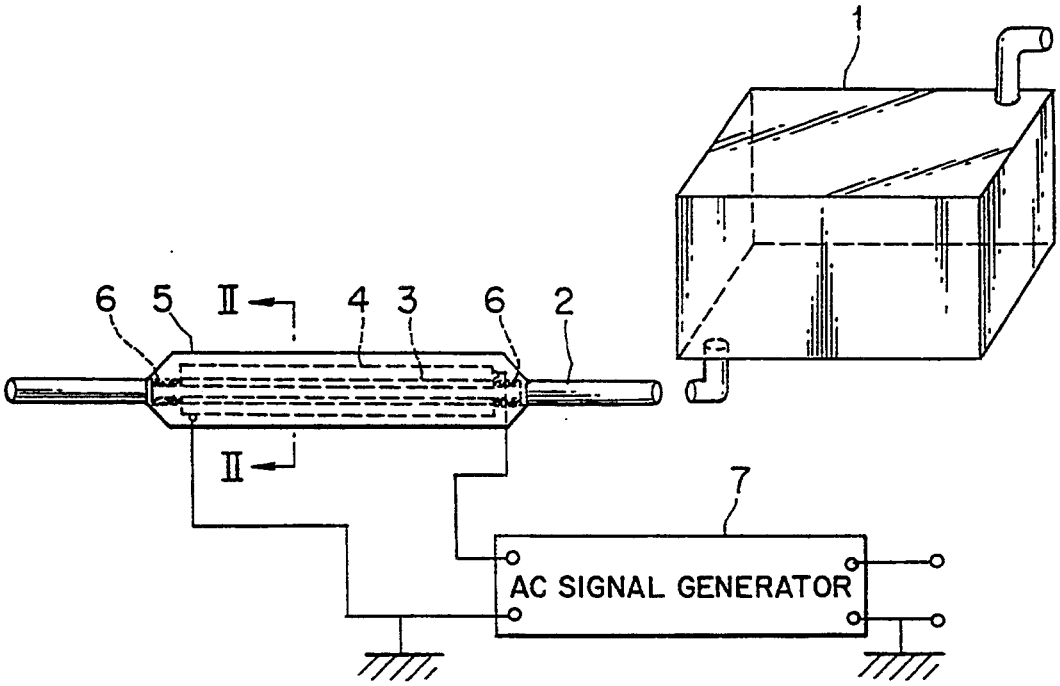
FIG. 1 is a view showing an arrangement of a device for purifying fuel according to a first embodiment of the present invention.
Figure 2:
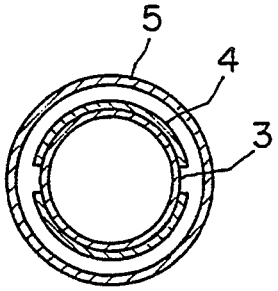
FIG. 2 is a cross-sectional view of FIG. 1 taken along the line II—II.

A first embodiment of the present invention will be described hereinafter with reference to FIGS. 1 to 3.

In the figures, denoted at 1 is a fuel tank loaded on an automobile, etc., a fuel supply pipe 2 is provided between the fuel tank 1 and an engine, not shown, and a fuel communication synthetic resin pipe 3 is interposed in the fuel supply pipe 2.

A pair of arc-shaped conductive plates 4 facing each other are arranged on the outer periphery of the fuel communication synthetic resin pipe 3 and is covered by a protective cover 5 so as to be prevented from getting out of position and from being broken due to vibration, etc. The fuel communication synthetic resin pipe 3 has threaded portions 6 and 6 at both ends thereof whereby the fuel communication synthetic resin pipe 3 is coupled to the the supply pipe 2.

Denoted at 7 is an AC signal generator, which is coupled to the positive and negative terminals of a battery loaded on an automobile, etc., at the input terminals thereof, and to the pair of arc-shaped conductive plates 4 set forth ;above at the output terminals thereof.

Figure 3:
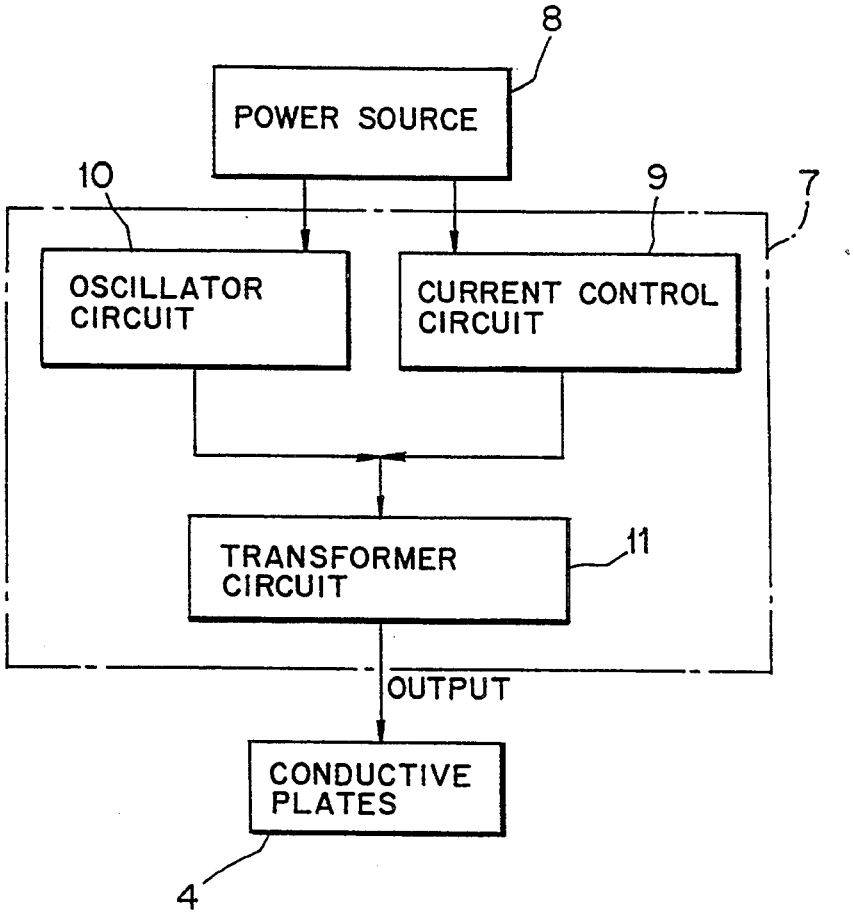
FIG. 3 is a schematic diagram for explaining an AC signal generator in FIG. 1.

FIG. 3 is a schematic block diagram including the AC signal generator 7 and the arc-shaped conductive plates 4, wherein current supplied from a power source 8 such as a battery, etc., is selectively controlled by a current control circuit 9 in the AC signal generator 7 within a range of 800 $\mu A \sim 1.8$ mA according to the kind of fuel and an oscillator circuit 10 can generate a signal having a frequency ranging from 30 Hz~130 Hz. A transformer circuit 11 transforms the signal in potential so as to selectively apply a voltage ranging from 1 V to 3 V between the arc-shaped conductive plates 4 set forth above according to the kind of fuel.

An experiment proved that the device for purifying fuel having such an arrangement set forth above should select a signal according to the kind of fuel, for example, a signal having a suitable frequency among frequencies ranging from 100 Hz to 130 Hz, a suitable voltage among voltages ranging from 1 V to 2.5 V and a suitable current among currents ranging from 800 μA to 1.5 mA in case of heavy oil or gas oil for less increasing dissolved oxygen for the purpose of reducing the generation of $NO_X$ and a signal having a suitable frequency among frequencies ranging from 30 Hz to 60 Hz, a suitable voltage among voltages ranging from 1 V to 3 V and a suitable current among currents ranging from 800 μA to 1.8 mA in case of gasoline for more increasing dissolved oxygen for the purpose of reducing the generation of CO. The reason why the amperage and voltage of the conductive plates are a little higher than those of the conductive coil is that current and voltage losses are larger in the conductive plates compared with the conductive coil.

The arc-shaped conductive plates 4 always form a given electrostatic induction field therebetween, which purifies fuel with certainty so long as a part of flowing fuel is in the region of the arc-shaped conductive plates facing each other even if insufficiently supplied fuel flows in the fuel supply pipe only through a part of the cross section thereof.

Although a pair of arc-shaped conductive plates 4 are arranged on the outer periphery of the fuel communication synthetic resin pipe 3 in the above embodiment, it is also possible to arrange plural pairs of arc-shaped conductive plates 4 thereon and apply signals having different frequencies, voltages and currents between the respective pairs of the arc-shaped conductive plates 4 within the ranges set forth above.

Figure 4:
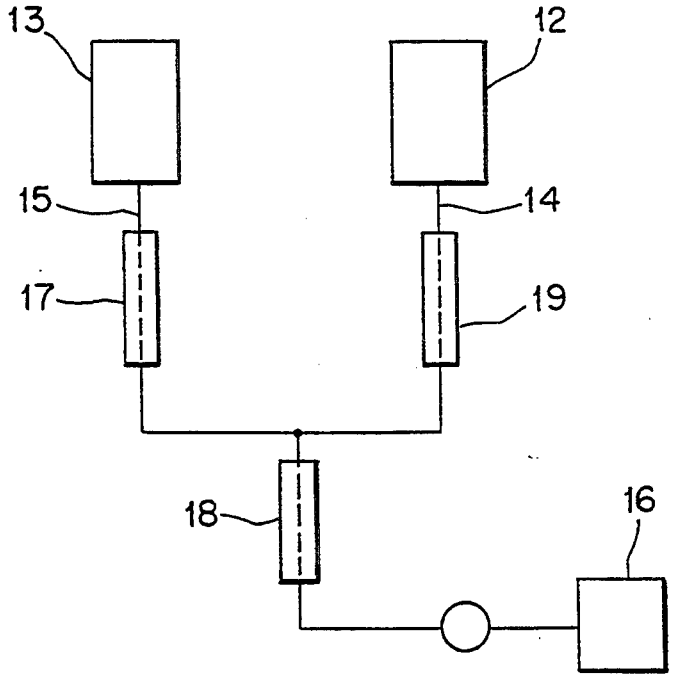
FIG. 4 is a view showing an arrangement of the device for purifying fuel according to a second embodiment of the present invention.

The present invention can be also used for purifying hydrous fuel as illustrated in FIG. 4. That is, a hydrous fuel supplying device for supplying oil and water by way of respective supply pipes 14 and 15 from an oil tank 12 and a water tank 13 which are provided independently from each other, mixing the same with each other and supplying the mixture of oil and water to a combustion chamber 16 may comprise a device 17 composed of arc-shaped conductive plates for applying an electrostatic induction field generated by a low frequency, low voltage and low current signal to the water supply pipe 15 coupled to the water tank 13 so as to reduce the specific gravity of water and mix said water with the oil from the oil tank 12 and a device 18 con, posed of arc-shaped conductive plates for further applying an electrostatic induction field generated by a low frequency, low voltage and low current signal to the mixed hydrous fuel.

The oil supply pipe 14 coupled to the oil tank 12 may be also provided with a device 19 thereon composed of arc-shaped conductive plates for applying an electrostatic induction field generated by a low frequency, low voltage and tow current signal to oil therein to thereby increase oxygen dissolved in oil and thereafter mix the oil with the water which has been reduced in specific gravity.

In this case, an experiment proved that hydrous fuel is purified very well when the AC signal generator 7 supplies a signal having a frequency of 50 Hz, a voltage of 17 V and a current controlled thereby to be, e.g. 10 mA to the device 17 and a signal having a frequency of 180 Hz, a voltage of 1.5 V and a current controlled thereby to be, e.g. 2~5 mA to the device 18 and moreover when it supplies a signal having a frequency of 100~110 Hz, a voltage of 10 V and a current controlled thereby to be, e.g. 5 mA to the device 19.

According to the present invention, an electromagnetic induction field generated by a low frequency, low voltage and low current signal is applied to fuel by way of the arc-shaped conductive plates to cause molecular variation therein so that dissolved oxygen in the fuel can be increased and consequently $NO_X$ or CO contained in the exhaust gas can be remarkably reduced, which is very advantageous from the viewpoint of the anti-pollution measures. Furthermore, since the arc-shaped conductive plates are employed, fuel is purified with certainty by the influence of the electrostatic induction field so long as a part of fuel flows through the region between the arc-shaped conductive plates facing each other, so that the device can purify the fuel with certainty even if a little amount of fuel flows down through the fuel supply pipe, and it can be manufactured more easily compared with that employing the conductive coil and furthermore it is free from the breaking of coil.

Since the process is performed along the fuel supply pipe between the fuel tank and the engine, the electrostatic induction field influences concentratedly and uniformity the fuel in the fuel supply pipe so as to facilitate the improvement of the fuel in quality and obviates an additional time for the process. The operability of the device is also superior in attaching or detaching.

What is claimed is:

1. A device for purifying fuel comprising:

a fuel communication synthetic resin pipe interposed in a fuel supply pipe between a fuel tank and an engine;

a pair of arc-shaped conductive plates facing each other arranged on the outer periphery of said fuel communication synthetic resin pipe;

a protective cover for covering the outer peripheries of said arc-shaped conductive plates; and an AC signal generator means coupled to a battery for applying a signal having a frequency ranging from 30 Hz to 130 Hz, a voltage ranging from 1 V to 3 V and a current ranging from 800 μA to 1.8 mA between said arc-shaped conductive plates.

2. A device for purifying fuel according to claim 1, wherein the device comprise plural pairs of said arc-shaped conductive plates facing each other on the outer periphery of said fuel communication synthetic resin.

3. A device for purifying hydrous fuel used in a hydrous fuel supply device which comprises a fuel supply pipe coupled to a fuel tank, a water supply pipe coupled to a water tank and a hydrous fuel supply pipe for supplying hydrous fuel to an engine comprising:

synthetic resin pipes interposed at least in said water supply pipe and said hydrous fuel supply pipe;

plural pairs of arc-shaped conductive plates facing each other each pair arranged on the outer periphery of each synthetic resin pipe;

protective covers for covering the outer peripheries of said arc-shaped conductive plates; and an AC signal generator means coupled to a battery for applying a signal having a frequency ranging from 50 Hz to 180 Hz, a voltage ranging from 1.5 V to 10 V and a current ranging from 2 mA to 10 mA between each pair of said arc-shaped conductive plates.

4. A device for purifying hydrous fuel according to claim 3, wherein plural pairs of said arc-shaped conductive plates are arranged on the outer periphery of each synthetic resin pipes.

* * * * *